United States Patent [19]

Regalbuto et al.

[11] Patent Number: 4,537,255

[45] Date of Patent: Aug. 27, 1985

[54] BACK-OFF TOOL

[75] Inventors: John A. Regalbuto; Jack E. Dines, both of Fort Worth, Tex.

[73] Assignee: Jet Research Center, Inc., Arlington, Tex.

[21] Appl. No.: 506,739

[22] Filed: Jun. 22, 1983

[51] Int. Cl.[3] ..... E21B 23/00

[52] U.S. Cl. ..... 166/297; 166/299; 166/63; 166/301; 166/55

[58] Field of Search ..... 166/297, 299, 301, 55, 166/55.1, 377, 63; 175/4.51, 4.56, 4.52; 102/314, 317, 318; 29/426.6, 421 E

[56] References Cited

U.S. PATENT DOCUMENTS

| | | | |
|---|---|---|---|
| 2,745,345 | 5/1956 | Sweetman | 166/63 |
| 2,749,840 | 6/1956 | Babcock | 175/4.56 |
| 2,866,508 | 12/1958 | Church | 175/4.52 |
| 2,873,675 | 2/1959 | Lebourg | 166/297 |
| 2,884,065 | 4/1959 | Bender | 166/63 |
| 2,911,909 | 11/1959 | Fuchs . | |
| 3,174,545 | 3/1965 | Mohaupt . | |
| 3,640,222 | 2/1972 | Graham | 102/318 |
| 4,007,790 | 2/1977 | Henning | 166/299 |
| 4,007,790 | 2/1977 | Henning . | |
| 4,266,613 | 5/1981 | Boop | 166/63 |
| 4,290,486 | 9/1981 | Regalbuto | 166/297 |
| 4,298,063 | 11/1981 | Regalbuto et al. | 166/55 |
| 4,345,646 | 8/1982 | Terrell | 166/297 |
| 4,352,397 | 10/1982 | Christopher | 166/297 |

OTHER PUBLICATIONS

*Condensed Chemical Dictionary,* Eighth Ed., p. 426, 1971, revised by Gessner G. Hawley.

*Primary Examiner*—Stephen J. Novosad
*Assistant Examiner*—M. Goodwin
*Attorney, Agent, or Firm*—Joseph A. Walkowski; Thomas R. Weaver

[57] ABSTRACT

A back-off tool comprising an explosive contained in a tubular housing which will disintegrate into fine particles upon detonation of the explosive. The explosive may be in the form of pellets so as to have the capability to vary the amount of explosive force by employing different diameter pellets and different numbers of pellets in the housing. A pressure compensation arrangement may be employed.

15 Claims, 3 Drawing Figures

BACK-OFF TOOL

BACKGROUND OF THE INVENTION

The present invention relates to a back-off tool adapted to be lowered into a pipe string in a well bore to apply an explosive shock at a threaded coupling between pipes in the pipe string so as to jar the coupling so that torque applied to the pipe string at the surface will "back off" the threads at that coupling to uncouple the string at that location.

The usual prior art device employed to accomplish this result comprises lengths of detonating cord taped to a central steel rod which is lowered by wireline into the pipe string, then electrically detonated at the desired location. This prior art method, known as a "string shot", leaves tape debris in the well and requires side detonation from cord to cord, which not only is somewhat unreliable, but produces a ragged, non-uniform explosion which may or may not produce a shock wave of the necessary magnitude and uniformity. Moreover, the detonating cord used in the prior art device must be shipped at a high cost due to explosive shipping regulations, because of the amount of explosive in a length of the cord.

U.S. Pat. No. 2,911,909 discloses a droppable back-off tool which is actuated by the impact of the tool on a sub previously placed at a particular location downhole. This has the disadvantage of not being able to effect the explosion where desired, as well as restricting the bore of the pipe. In addition, there is no assurance that the tool impact will be great enough to actuate the detonator. Moreover, the tool employs detonating cord which must be somehow maintained in a groove on the tool exterior, the means for such maintenance not being disclosed.

U.S. Pat. No. 4,007,790 discloses a back-off apparatus which relies upon a non-destructive explosive to provide a jarring force to a pipe coupling through mechanical jarring means. The nature or configuration of the explosive is not disclosed. Moreover, the explosive force which may be applied to the pipe coupling is limited by the reusable nature of the apparatus.

Another prior art device which appears superficially to be similar to the back-off tool of the present invention is disclosed in U.S. Pat. No. 3,174,545. The patent discloses a device employed in a method of explosive-induced hydraulic fracturing, which device includes an explosive contained in a frangible housing, which explosive is detonated by electrically actuated detonating means. However, the device as disclosed produces an irregular, pulsating explosion or series of explosions to generate fluid pressure pulsations, and fragments of the destroyed housing are designed to plug some of the perforations in the well bore casing so that the hydraulic force will act more strongly against others. This device is obviously unsuitable for use as a back-off tool due to the design of the explosive charge as well as the relatively large nature of the housing fragments produced as a result of the explosive detonation, which fragments could inhibit subequent drilling, well treatment and production.

SUMMARY OF THE PRESENT INVENTION

The present invention comprises a back-off tool having a tubular housing reducible to fine particles upon detonation of the explosive contained within, which explosive may be in the form of pellets so as to easily vary the amount of explosive force generated. One preferred embodiment employs a pressure-tight housing for the explosive; a second preferred embodiment utilizes well bore pressure to act upon the explosive, substantially balancing interior and exterior housing pressures so as to permit a thinner housing.

BRIEF DESCRIPTION OF THE DRAWINGS

The back-off tool of the present invention will be more readily understood by reference to the detailed descriptions of the preferred embodiments as set forth hereafter, taken in conjunction with the accompanying drawings, wherein.

DETAILED DESCRIPTION OF A FIRST PREFERRED EMBODIMENT OF THE INVENTION

Figure 1A:
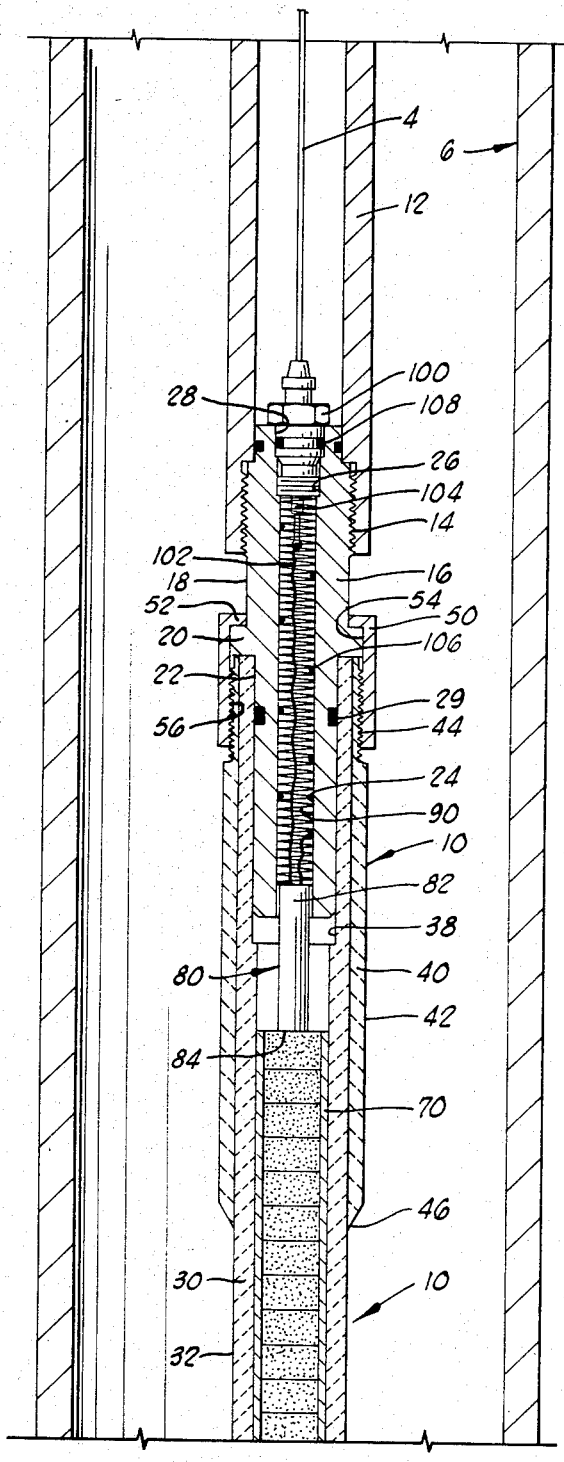
FIGS. 1A and 1B are a full vertical section of a first preferred embodiment of the back-off tool of the present invention shown in position adjacent a threaded coupling in a pipe string.
Figure 1B:
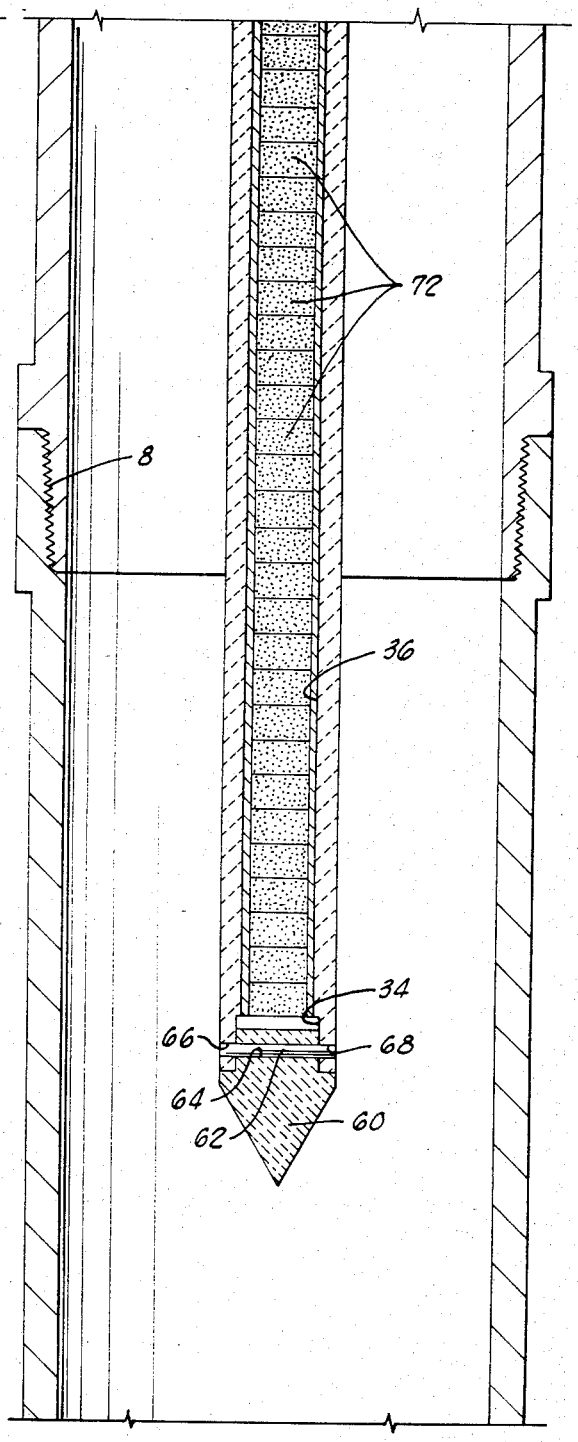

FIGS. 1A and 1B illustrate a first preferred embodiment of the present invention. Back-off tool 10 is shown suspended in a pipe string 6 adjacent threaded coupling 8. Extension mandrel 12, which is preferably formed of steel, is threaded at 14 to steel firing head mandrel 16. Electrical wireline 4 extends upward to the top of extension mandrel 12, where it is secured thereto (not shown), subsequently extending to the drilling rig at the surface. Below threaded connection 14, firing head mandrel 16 has a substantially cylindrical upper exterior surface 18 which terminates at annular shoulder 20, below which a lower cylindrical exterior surface 22 extends to the bottom of firing head mandrel 16, O-ring 29 forming a fluid-tight seal therebetween. Tubular sleeve 40 surrounds the upper exterior of housing 30, and has a cylindrical exterior surface 42 which terminates in threads 44 at its upper end, which does not quite extend to the top of housing 30. Housing 30 and sleeve 40 are preferably formed of a non-metallic filamentary or fiber-reinforced composite material which is reducible to fine particulate matter when subjected to an explosive force. Such materials include, but are not limited to, graphite reinforced epoxy or glass reinforced epoxy, which materials are commercially available from Hercules, Inc., Skyline Industries and numerous other manufacturers. The selected material must possess sufficient strength so as not to rupture or distort (thereby causing leakage) under well bore pressures, which could affect the detonation or performance of the back-off charge. Housing 30 and sleeve 40 may be epoxy bonded together at area 46, or throughout the length of their contact.

Connector 50 rides upon upper cylindrical surface of firing head mandrel 16, through the contact of radially inward extending annular shoulder 52 therewith. Below annular shoulder, inner bore 54 is threaded at its lower extent 56 to mate with threads 44 on sleeve 40. When threads 44 and 56 are made up, connector 50 maintains housing 30 tightly against annular shoulder 20 on firing head mandrel 16.

Plug 60, preferably of a similar material to housing 30, is inserted in the lower bore 34 of housing 30, and is secured thereto by steel pin 62, which extends through radial bore 64 in plug 60 and radial apertures 66 and 68 at the lower end of housing 30. As noted above, plug 60 is also preferably of a filamentary composite material, and is epoxy bonded about its periphery to housing 30 to ensure a fluid and pressure-tight seal, plug 60, housing 30 and firing head mandrel 26 forming a pressure-tight vessel.

Within intermediate housing bore 36, tube 70, which may comprise paper, contains a plurality of explosive pellets 72. The grain loading (mass of explosive per foot of length) of the pellets may be easily varied by varying the pellet diameter and employing tubes 70 of greater or lesser wall thickness to ensure a snug fit of the explosive pellets therein. Pellets 72 may comprise any of a number of suitable explosive compounds, including but not limited to: cyclotrimethylenetrinitramine, hexahydro-1,3,5-trinitro-5-triazine, cyclonite, hexogen, T4, commonly referred to as RDX; octogen, known as HMX; 2,2',4,4',6,6'-hexanitrostilbene, known as HNS; or 2,6-bis(Picrylamino)-3,5,dinitropyridine, known as PYX. In addition to the advantage of variable loading, it should be noted that by forming the explosive as pellets 72, the explosive can be grouped in packets of no more than 22.7 grams total weight each, so as to enable their shipment as class "C" explosives. The ability to ship the pellets as class "C" explosives greatly facilitates their transportability on commercial carriers, and therefore reduces the time, money and effort spent to transport the back-off tool to the site of usage. The desired number of pellets may then be inserted into tube 70 and tube 70 inserted into housing 30 prior to the insertion of firing head mandrel 16 into upper housing bore 38.

After pellets 72 in tube 70 have been inserted in housing 30, electrically actuated booster charge 80 is inserted into housing 30 at the end of firing head mandrel 16. The upper portion 82 of booster charge 80 rides in lower mandrel bore 24, and the bottom end 84 of booster charge 80 is biased against the top pellet 72 by coil spring 90 which extends from firing connector head 100 to booster charge 80. Ignition wire 102 extends from booster charge 80 through the center of spring 90 to firing connector 104. Firing connector head 100 has annular groove around its periphery by which O-ring 108 maintains a fluid-tight seal against upper bore 28. Firing connector 104 is electrically insulated from the outer shell of firing connector head 100 and firing head mandrel 16. Ground wire 106 winds around the periphery of coil spring 90 from booster charge 80 and grounds out on firing head mandrel 16 through firing connector head 100.

DETAILED DESCRIPTION OF A SECOND PREFERRED EMBODIMENT OF THE INVENTION

Figure 2:
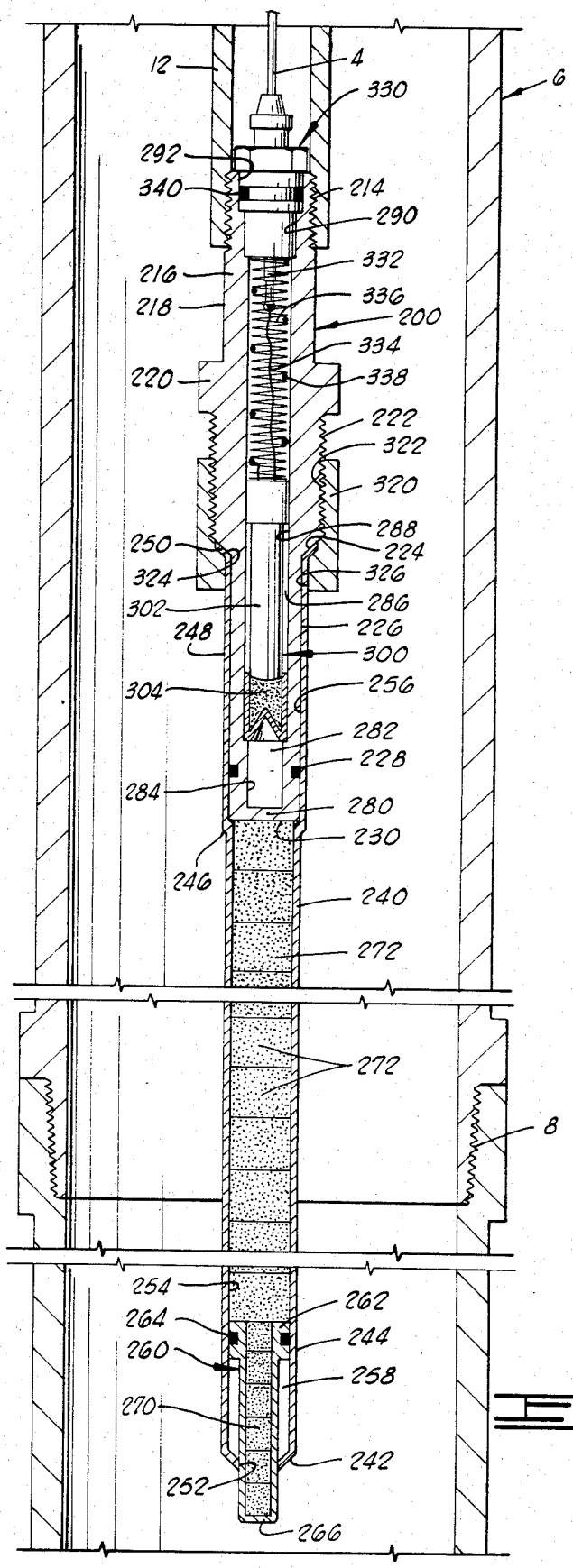
FIG. 2 is a drawing similar to FIGS. 1A and 1B showing a second preferred embodiment of the back-off tool of the present invention.

FIG. 2 of the drawings shows a second preferred embodiment of the back-off tool of the present invention. Back-off tool 200 is suspended in pipe string 6 adjacent threaded coupling 8. Extension mandrel 12 is threaded to firing head mandrel 216 at 214. As in FIG. 1, electrical wireline 4 extends upward to the top of extension mandrel 12 where it is secured thereto (not shown), subsequently extending to the drilling rig at the surface.

Below threaded connection 214, firing head mandrel 216 comprises on its exterior cylindrical surface 218, radially outward extending annular shoulder 220, threaded cylindrical surface 222, oblique annular wall 224, and lower cylindrical surface 226 in which O-ring 228 is held in an annular groove (unnumbered). The bottom 230 of firing head mandrel is radially flat.

Tubular housing 240, is preferably formed of the same materials as housing 30 of the first preferred embodiment of FIGS. 1A and 1B. Furthermore, housing 240 has a much thinner wall than housing 30, the mechanism by which a thinner wall is made practical being explained hereafter. Housing 240 possesses an exterior surface having an annular surface 242 at its lower extent, followed by lower cylindrical surface 244, which steps at 246 to upper cylindrical surface 248, which terminated in flared end 250. The lower end of housing 240 has axial aperture 252 therethrough, opening into pressure compensation chamber 258, radially defined by lower bore 254, which extends upward to upper bore 256, terminating at flared end 250. Tubular shell nut 320 having threaded bore 322 therein terminating at obliqued annular shoulder 324, which leads radially inwardly to lower smooth bore 326. Shell nut 320 secures firing head mandrel 216 and housing 240 together when threads 222 and 322 are made up.

Tubular pressure compensation plug 260 is preferably of the same material as housing 240, with the same or lesser wall thickness. At its upper end, plug 260 has collar 262 of slightly lesser exterior diameter than the diameter of bore 256, O-ring seal 264 forming a substantially fluid and pressure-tight sliding seal between collar 262 and housing 240. Lower end 266 of plug 260 is closed. Plug 260 contains a plurality of explosive pellets 270, which may be formed of the same explosive compounds noted with respect to pellets 72 in FIGS. 1A and 1B. U.S. Pat. No. 3,174,545, previously described herein with respect to the background of the present invention, discloses the use of a pressure compensation piston or plug. However, the configuration of the plug disclosed therein and the characteristics of the explosive employed render it unsuitable for use in a back-off tool as that plug would either remain undestroyed after explosion of the explosive material or comprise very large fragments.

Likewise, larger explosive pellets 272 in housing 240 may be of those same explosive compounds. Of course, the same advantages of pelletized explosives previously enumerated with respect to back-off tool 10 are equally applicable to back-off tool 200. As in tool 10, the explosive pellets may be placed within a paper tube prior to insertion in housing 240 for convenience and ease of handling, including easy variation of grain loading for the same diameter housing.

Flat lower end 230 of firing head mandrel has barrier wall 280 therebehind, above which standoff chamber 282 defined by lower bore wall 284 is located. Above standoff chamber 282, booster charge chamber 286 is defined by intermediate bore wall 288 of larger diameter than bore wall 284. Stepped bore walls 290 and 292 above intermediate bore wall 288 lead to the top of firing head mandrel 216.

Booster assembly 300 comprises booster charge 302, similar to booster charge 80. However, in addition to booster charge 302, booster assembly 300 additionally employs shaped charge booster 304 at its lower end. Booster assembly 300 is placed into firing head mandrel 216, but does not go to the bottom thereof due to the small diameter of lower bore wall 284, which thereby assures proper standoff for shaped charge booster 304. Booster assembly 300 is connected to firing head connector 332 of firing head 330 by ignition wire 334, which runs through the center of coil spring 336. Firing head connector 332 is electrically insulated from the shell of firing head 330 and firing head mandrel 216. Ground wire 338 is wound about spring 336, and grounded on firing head mandrel 216 through the exterior shell of firing head 330. O-ring 340 effects a fluid and pressure-tight seal between firing head 330 and firing head mandrel 216, booster assembly 300 thereby being contained within a pressure-tight vessel.

OPERATION OF THE PREFERRED EMBODIMENTS

Back-off tools 10 and 240 operate in substantially the same manner. Both are preferably transported to the well site without booster charges or pelletized explosives. The desired size pellets for proper grain loading are selected, and if necessary for proper fit, placed in a paper tube prior to insertion in the back-off tool housing. A common grain loading which may be employed in tools 10 and 200 is 600 grains/foot of HMX explosive.

In loading back-off tool 10, booster charge 80 is placed in firing head mandrel 16 with spring 90 thereabove, and wires 102 and 106 connected to firing head 100. Firing head mandrel 16 is then inserted into housing 30, and firing head 100 inserted securely into firing head mandrel 16, which assures proper biasing of booster charge 82 against top pellet 72 by spring 90, charge 80 being centered due to the extension of upper portion 82 into firing head mandrel 16. Connector 50 is made up on sleeve 40, holding firing head mandrel 16 in place, shoulder 20 being held between connector 50 and housing 30. Extension mandrel 12 is then made up with firing head mandrel 16 and back-off tool 10 lowered to its location across threaded coupling 8. It should be noted that pellets 72 and booster charge 80 are within a pressure-tight vessel, isolated from well bore fluid and pressure to ensure proper detonation.

When tool 10 is in its proper location, left-hand torque is applied to pipe string 6 from the surface, as back-off tool 10 activated electrically through wireline 4, pellets 72 exploding and providing a shock wave to free threaded coupling 8 and allow retrieval of the portion of pipe string 6 thereabove. Exploding pellets 72 result in the reduction of the majority of housing 30 and sleeve 40 and substantially all of plug 60 to a fine powder, which will not interfere with future operations, as might the larger fragments of the prior art. Of course, tube 70 will be destroyed, and firing head mandrel 16 with fragments of the top of housing 30 and sleeve 40 will be retrieved on wireline 4.

Back-off tool 200 is assembled in a slightly different manner. Pressure compensation plug 260 will be filled with pellets 270 to assure its destruction, and plug 260 inserted into housing 240 from the top end. Pellets 272 are then inserted into housing 240 above plug 260, inside a paper tube if necessary for proper grain loading. Firing head mandrel 216 is then loaded with booster assembly 300, connected to firing head 330 by wires 334 and 338, with spring 336 therebetween. Firing head mandrel 216 is inserted into housing 240, and shell nut 320 made up to secure the two pieces together. Firing head 330 is then inserted securely into firing head mandrel 216, creating a pressure-tight vessel for booster assembly 300. Exterior mandrel 12 is made up, and back-off tool 200 is lowered to its position across coupling 8. As tool 200 is lowered, pressure from the well bore is allowed to act upon the interior of housing 240 through pressure compensation plug 260, thereby preventing its collapse and the collapse of plug 260 even with their exceedingly thin walls.

When back-off tool 200 is in position, left-hand torque is applied to coupling 8 through pipe string 6 from the surface. An electrical current is sent through wireline 4, which activates primary booster charge 302, setting off shaped booster charge 304, the resulting high velocity jet travelling through standoff chamber 282, piercing barrier wall 280 and igniting pellets 270 and 272, which explode and produce a shock wave to permit coupling 8 to disengage. Housing 240 and plug 260 will be substantially completely reduced by the explosion to very fine fragments, which will not interfere with further drilling operations. Firing head mandrel 216, shell nut 320 and the undestroyed residue of housing 240 will be retrieved from the well on wireline 4.

Thus it is apparent that a novel and unobvious back-off tool has been invented. Of course, certain modifications, additions and deletions to the preferred embodiments as disclosed herein may be made without departing from the spirit and scope of the claimed invention.

We claim:

1. A back-off tool for use in a conduit in a well bore, comprising:

a pressure-tight firing head mandrel having disposed therein a shaped booster charge; and a tubular housing secured to said firing head mandrel and having a plurality of explosive pellets disposed in mutually abutting relationship therein;

said shaped booster charge being adapted to pierce the wall of said firing mandrel and initiate said explosive pellets, said tubular housing being adapted to substantially disintegrate upon initiation of said pellets.

2. The back-off tool of claim 1, wherein said shaped booster charge is biased against one of said plurality of explosive pellets by spring means.

3. The back-off tool of claim 1, wherein said explosive pellets are inserted in a tube means prior to being disposed in said tubular housing, whereby the grain loading of said back-off tool may be varied by employing tube means of varying interior diameter and wall thickness, and explosive pellets of various diameters.

4. The back-off tool of claim 1, wherein said tubular housing includes pressure compensation means adapted to subject said explosive pellets to pressure in said conduit, said pressure compensation means adapted to substantially disintegrate upon detonation of said explosive pellets.

5. The back-off tool of claim 4, wherein said pressure compensation means comprises a pressure compensation plug containing some of said explosive pellets and slidably inserted in said tubular housing with seal means between said plug and said housing.

6. The back-off tool of claim 5, wherein said tubular housing and plug comprise a non-metallic filamentary composite material.

7. The back-off tool of claim 6, wherein said material is selected from the group consisting of glass-reinforced epoxy and graphite-reinforced epoxy.

8. The back-off tool of claim 5, wherein said tubular housing and plug comprise a non-metallic fiber-reinforced composite material.

9. The back-off tool of claim 8, wherein said material is selected from the group consisting of glass-reinforced epoxy and graphite-reinforced epoxy.

10. The back-off tool of claim 1, wherein:

said tubular housing is adapted to provide a substantially pressure-tight vessel for said explosive pellets.

11. The back-off tool of claim 10, wherein said tubular housing comprises a non-metallic filamentary composite material.

12. The back-off tool of claim 11, wherein said material is selected from the group consisting of glass-reinforced epoxy and graphite-reinforced epoxy.

13. The back-off tool of claim 10, wherein said tubular housing comprises a non-metallic fiber-reinforced composite material.

14. The back-off tool of claim 13 wherein said material is selected from the group consisting of glass-reinforced epoxy and graphite-reinforced epoxy.

15. A method of backing off a conduit joint in a well bore, comprising:

disposing, adjacent said joint, an explosive in the form of a plurality of mutually abutting explosive pellets in a non-metallic housing adapted to substantially disintegrate upon detonation of said explosive;

pressurizing said explosive to substantially the level of pressure in said well bore adjacent said joint;

applying torque to said joint;

detonating said explosive and substantially disintegrating said housing while maintaining said torque; and backing off said joint subsequent to said detonation of said explosive and disintegration of said housing.

* * * * *